United States Patent [19]

Waid et al.

[11] 4,226,645

[45] Oct. 7, 1980

[54] STEEL WELL CASING AND METHOD OF PRODUCTION

[75] Inventors: George M. Waid, Burton; Robert T. Ault, Shaker Heights, both of Ohio

[73] Assignee: Republic Steel Corp., Cleveland, Ohio

[21] Appl. No.: 1,750

[22] Filed: Jan. 8, 1979

Related U.S. Application Data

[63] Continuation-in-part of Ser. No. 866,754, Jan. 3, 1978, abandoned, which is a continuation-in-part of Ser. No. 752,441, Dec. 20, 1976, abandoned.

[51] Int. Cl.[2] ..... C21D 9/08

[52] U.S. Cl. ..... 148/2; 75/124; 148/12.4; 148/36; 148/143

[58] Field of Search ..... 148/134, 143, 144, 36, 148/2, 12.4; 75/123 L, 126 C, 126 E, 126 F, 124, 125

[56] References Cited

U.S. PATENT DOCUMENTS 3,992,231 11/1976 Timmons ..... 148/143

*Primary Examiner*—R. Dean

*Attorney, Agent, or Firm*—Watts, Hoffmann, Fisher & Heinke Co.

[57] ABSTRACT

Steel well casing having the combined properties of excellent resistance to hydrogen sulfide stress corrosion and high yield strength ranging upward from 90,000 to 145,000 psi comprised of an aluminum-killed steel alloyed with chromium, molybdenum and vanadium. The casing is quenched to martensite from an austenitizing temperature in the range of from 1550° to 1700° F. and is tempered in the range of from 1200° to 1400° F. to a maximum hardness of 35 $R_C$.

8 Claims, No Drawings

STEEL WELL CASING AND METHOD OF PRODUCTION

CROSS-REFERENCE TO RELATED APPLICATION

This application is a continuation-in-part of application Ser. No. 866,754 entitled Well Casing Steel, filed Jan. 3, 1978 and now abandoned, which was a continuation-in-part of application Ser. No. 752,441 filed Dec. 20, 1976 for Well Casing Steel and now abandoned.

BACKGROUND OF THE INVENTION

The present invention relates generally to steel well casing, and more specifically to new and useful improvements in the manufacture of well casing characterized by superior resistance to hydrogen sulfide stress corrosion and high yield strength.

Considerable work has been done in recent years to develop higher strength casing steels which exhibit better resistance to failure under stress and corrosive conditions resulting from exposure to liquids containing hydrogen sulfide, as in sour oil applications. The need for higher strength hydrogen sulfide cracking resistant steels has become more apparent with the increasing energy demands and the descrease of easily obtained sweet oil reserves. Oil fields now being explored require drilling to depths beyond 20,000 feet with bottom hole pressures and temperatures exceeding 24,000 psi and 400° F., where hydrogen sulfide is often found in the crude oil. Under these conditions, steel well casing is progressively embrittled in the presence of the hydrogen sulfide and subsequently cracks and fails under the stresses to which the casing is subjected.

Many metallurgical factors influence the sulfide stress cracking behavior of steel well casing. These factors include the microstructure, composition, heat treatment, strength and hardness of the steel. All of these factors are interrelated and must be closely controlled. Small deviations from optimum limits of only one factor, such as the temperatures of heat treatment, will adversely affect sulfide cracking resistance even though other factors such as composition remain unchanged. Chemical composition affects the resistance to hydrogen sulfide cracking of steels by changing such metallurgical characteristics of the steel as hardenability, transformation characteristics and tempering response which, in turn, result in changes in strength and microstructure. The influence of particular alloying and impurity elements on sulfide stress cracking resistance changes from one alloy system to another and the effects of these elements also dramatically change with changes in strength level. As a consequence, the effect on hydrogen sulfide stress cracking resistance of an element in one alloying system cannot be compared to or predicated from the effect of that element in another system.

Prior to the present invention, it had been generally concluded that casing steels having high yield strength levels of about 90,000 psi or higher were generally more susceptible to hydrogen sulfide stress cracking than lower strength steels. Although investigators have recognized the need for higher strength casing steels, the prior art has not provided a steel composition and a compatible heat treatment procedure that made it possible to appreciably increase the yield strength above 90,000 psi and at the same time improve the resistance to hydrogen sulfide stress cracking.

One prior art suggestion for improving the hydrogen sulfide stress corrosion resistance of casing steel is disclosed in U.S. Pat. No. 2,895,861. It is proposed in that patent to use low alloy steels containing chromium, molybdenum, vanadium, silicon and manganese and to subject these steels to a heat treatment consisting of austenitization at an elevated temperature in the range from 1787° to 2012° F., cooling at a speed at least equal to air cooling, and tempering at a temperature in the range of from 1337° to 1472° F. U.S. Pat. No. 2,895,861 specifies that the yield point of the steel should not be greater than 65 kg./mm.$^2$ or about 92,500 psi. The patent teaches that tempering temperatures below 1337° F. (725° C.) and yield strengths higher than 65 kg./mm.$^2$ (92,500 psi) are to be avoided in the case of the specifically disclosed steels which are austenitized and cooled in the manner described because of the detrimental effect on resistance to sulfide stress cracking.

Another hydrogen sulfide stress corrosion resistant steel is disclosed in U.S. Pat. No. 2,825,669. The low alloy steel of that patent contains as essential ingredients, in addition to an extremely close tolerance of carbon, small amounts of manganese, chromium, aluminum and silicon. An aluminum content of from 0.15 to 1.20% by weight is disclosed as being required to promote and accelerate migration and dispersions of carbides into the ferrite grains, impart stress corrosion resistance, and to strengthen ferrite. The composition also may include as nonessential or optional ingredients molybdenum, vanadium and titanium. The steel is given a preliminary anneal by soaking at about 1364°–1436° F. for the apparent purpose of diffusing or dispersing the carbide aggregates throughout the ferrite grains before the carbides are dissolved by a subsequent high temperature austenitizing treatment. According to the patent disclosure, the steel may be used in the state obtained after the dispersion or diffusion treatment, or the steel may be subjected to an optional austenitization, quench and temper treatment. The steel is austenitized at a high temperature in the range of from 1778°–1976° F. The quenching treatment to which the steel is subjected after austenitization may result in a microstructure containing martensite as well as other transformation products such as bainite, etc. As in the case of U.S. Pat. No. 2,895,861, the examples of U.S. Pat. No. 2,825,669 involve steels heat-treated to produce yield strengths less than about 90,000 psi.

SUMMARY OF THE INVENTION

The purpose of this invention is to provide a casing steel which is not subject to the objections of the prior art, and more particularly a steel well casing which exhibits improved resistance to sulfide stress corrosion cracking at any given strength level and, conversely, higher strengths at any given level of sulfide stress cracking resistance.

It has been found that an unexpected improvement of sulfide stress cracking resistance together with high yield strength can be achieved in a low alloy, fine grain, aluminum-killed steel containing carefully controlled amounts of molybdenum, vanadium and chromium as essential ingredients by a quench and temper heat treatment carried out at critical temperatures to obtain a specified maximum hardness and a fully tempered martensitic microstructure. The specific combination or interrelation of composition, heat treatment procedure and microstructure is novel and achieves a synergistic effect that is an improvement over the casing steel practices and compositions of the prior art in terms of improved sulfide stress cracking resistance and high strength. In particular, the invention makes it possible to produce a well casing characterized by yield strengths ranging from 90,000 to 145,000 psi and by unexpectedly improved sulfide stress cracking resistance at any given strength level.

One aspect of the invention consists of a process of making well casing characterized by improved hydrogen sulfide stress corrosion resistance at high yield strengths ranging upward from 90,000 to 145,000 psi comprising the steps of providing an aluminum-killed steel consisting essentially in amounts by weight of from 0.10 to 0.40% carbon, 0.25 to 0.75% manganese, 0.05 to 0.50% silicon, 1.0 to 5.0% chromium, 0.30 to 1.0% molybdenum, 0.05 to 0.55% vanadium, 0.02 to 0.10% aluminum, and the balance iron except for normal steel making impurities, including up to 0.04% for each of sulfur and phosphorus; rolling and forming the steel into tubular form; austenitizing the casing at a temperature in the range of from 1550° to 1700° F.; quenching the casing to obtain a microstructure which is essentially martensite; and tempering the casing at a temperature in the range of from 1200° to 1400° F. to a maximum hardness of 35 $R_C$.

Another aspect of the invention is a new, quenched and tempered well casing characterized by improved hydrogen sulfide stress corrosion resistance at high yield strengths ranging upward from 90,000 to 145,000 psi comprised of an aluminum-killed, quenched and tempered steel consisting essentially in amounts by weight of from 0.10 to 0.40% carbon, 0.25 to 0.75% manganese, 0.05 to 0.50% silicon, 1.0 to 5.0% chromium, 0.30 to 1.0% molybdenum, 0.05 to 0.55% vanadium, 0.02 to 0.10% aluminum and the balance iron except for minor steel making impurities including up to 0.04% for each of sulfur and phosphorus, the steel having a maximum hardness of 35 $R_C$ and a microstructure which is essentially tempered martensite.

According to a narrow, more specific aspect of the invention, the new well casing and process utilizing a steel consisting essentially in amounts by weight of from 0.15 to 0.35% carbon, 0.35 to 0.65% manganese, 0.10 to 0.35% silicon, 1.5 to 3.0% chromium, 0.40 to 0.80% molybdenum, 0.10 to 0.30% vanadium, 0.02 to 0.08% aluminum, 0 to 1.0% nickel, 0 to 0.25% titanium, 0 to 1.0% copper, 0 to 3.0% cobalt, 0 to 0.25% tungsten, 0 to 0.50% tantalum, 0 to 0.10% and more specifically 0.01 to 0.05% columbium, and the balance iron except for minor steel making impurities including up to 0.025% for each of sulfur and phosphorus.

The steel casing of the present invention is austenitized at a temperature in the range from 1550° to 1700° F. as compared to temperature ranging from 1778° to 2012° F. in the case of U.S. Pat. Nos. 2,895,861 and 2,825,669. One reason for the improved sulfide stress cracking resistance characterizing the steel of the invention is believed to be because the lower austenitization temperature avoids complete dissolution of the vanadium carbides. The lower austenitization temperature also results in a finer grain size. As further distinguished from the above-discussed patents, it is critical to the practice of the present invention that the steel be quenched to obtain a microstructure consisting essentially of martensite.

The hydrogen sulfide stress corrosion resistance of the new casing steels of the invention were evaluated by exposing notched cantilever loaded specimens to a hydrogen sulfide solution having pH of 3. The tests were run for a period of 300 hours, and a survival stress level (designated as sigma 50) was statistically determined. The survival stress level represents a median stress level above which 50% of the specimens failed in 300 hours and below which 50% of the specimens did not fail in 300 hours. Tested by this method, casing steels of the invention exhibit sigma 50 survival stress levels ranging upward from about 115,000 psi.

Additional advantages and a fuller understanding of the invention will be had from the following detailed description.

DESCRIPTION OF PREFERRED EMBODIMENTS

The steel composition characterizing the new well casing and the process of the invention is alloyed with 1.0 to 5.0% and more preferably 1.5 to 3.0% chromium, 0.30 to 1.0% and more preferably 0.40 to 0.80% molybdenum, and 0.05 to 0.55% and more preferably 0.10 to 0.30% vanadium.

Chromium has the effects of decreasing the diffusivity of hydrogen in iron and increasing the sulfide stress corrosion resistance of martensitic high-strength steels. In addition, chromium is an alloy carbide former and provides a means for maintaining high-strength levels while increasing tempering temperature. Increasing the chromium level from 1.0 to 2.0% in an alloy steel containing about 0.30% carbon, 0.72% molybdenum and 0.22% vanadium produced a pronounced beneficial effect on sulfide stress corrosion resistance. At the 1% chromium level, the sigma 50 survival stress level was about 146,000 psi, and at the 2% chromium level the sulfide stress corrosion resistance was raised to 196,000 psi.

Molybdenum also improves sulfide stress cracking resistance at yield strengths above 90,000 psi. In one test, the sigma 50 survival strength level of a medium carbon alloy steel (0.30% carbon, 2.0% chromium and 0.20% vanadium) increased from 163,000 psi to 191,000 psi with an increase in molybdenum content from 0.24% to 0.62%. A further increase in molybdenum content produced a decrease in hydrogen sulfide stress cracking thus indicating the optimum level to be in the range of from 0.60 to 0.70%.

Vanadium has been shown to produce a marked improvement in sulfide stress corrosion resistance in amounts up to about 0.20%. At higher vanadium levels, for example levels in excess of about 0.30%, no additional improvement in sulfide stress cracking resistance was observed. The beneficial effect of vanadium is thought to result from its role as a carbide former which allows the use of higher tempering temperatures to reach a given strength level.

The steels characterizing the product and process of this invention are aluminum-killed and, as such, contain aluminum in amounts of from about 0.02 to 0.10% and more preferably about 0.02 to 0.08%. At these low levels resulting from the use of aluminum as a deoxidizer, there is no marked effect on sulfide stress cracking resistance. Tests conducted with chromium-molybdenum-vanadium alloyed steels have shown that amounts of aluminum greater than about 0.10%, and more particularly in the range of from 0.30 to 0.41%, result in significantly poorer sulfide stress cracking resistance at all strength levels as compared to the steels of the present invention.

Columbium may be included in the composition as an optional ingredient in amounts up to about 0.10%. Tests have shown that columbium causes a slight improvement in sulfide stress cracking resistance up to an amount of about 0.05%. No appreciable benefits are observed by increasing the columbium content above this level.

Other optional ingredients are nickel up to about 1.0%, titanium up to about 0.25%, copper up to about 1.0%, cobalt up to about 3.0%, tungsten up to about 0.25%, and tantalum up to about 0.50%. If desired, these optional ingredients may be present in the steel in the maximum amounts indicated without producing any pronounced effect on sulfide stress cracking resistance.

The invention is further described by the following examples and comparisons.

Test specimens were made from several heats of aluminum-killed steels having the compositions set forth in the following Table I. The specimens were austenitized, quenched and tempered. The austenitization and tempering temperatures, the mechanical properties, hardnesses, and the sigma 50 survival stress levels are presented in Table II.

TABLE I

| Heat No. | C | Mn | Si | P | S | Cr | Mo | V | Cb | Al |
|---|---|---|---|---|---|---|---|---|---|---|
| X439 | 0.24 | 0.54 | 0.25 | 0.015 | 0.021 | 1.80 | 0.68 | 0.23 | — | 0.037 |
| X440 | 0.24 | 0.53 | 0.28 | 0.016 | 0.021 | 1.90 | 0.63 | 0.24 | — | 0.040 |
| X441 | 0.25 | 0.53 | 0.27 | 0.015 | 0.022 | 1.90 | 0.66 | 0.24 | 0.047 | 0.045 |
| X442 | 0.26 | 0.53 | 0.29 | 0.014 | 0.020 | 1.90 | 0.66 | 0.24 | 0.12 | 0.015 |
| X227 | 0.16 | 0.54 | 0.32 | <0.008 | 0.018 | 2.00 | 0.32 | 0.10 | — | 0.30 |
| X228 | 0.18 | 0.52 | 0.32 | 0.013 | 0.017 | 1.00 | 0.30 | 0.10 | — | 0.39 |

TABLE II

| Example | Heat No. | Aust. Temp. (F.) | Tempering Temp (F.) | Y.S. (ksi) | U.T.S. (ksi) | R.A. (%) | Elong. (% in 1") | Hardness (Rc) | Sigma 50 (ksi) |
|---|---|---|---|---|---|---|---|---|---|
| 1 | X439 | 1700 | 1150 | 164.9 | 182.9 | 61.5 | 17.0 | 40.7 | 21.1 |
| 2 | X439 | 1700 | 1200 | 151.4 | 165.5 | 63.9 | 17.0 | 37.4 | 48.3 |
| 3 | X439 | 1700 | 1250 | 131.0 | 144.0 | 66.6 | 20.0 | 31.9 | 163.8 |
| 4 | X439 | 1700 | 1300 | 110.1 | 125.4 | 69.7 | 22.5 | 25.5 | 195.0 |
| 5 | X440 | 1700 | 1150 | 162.0 | 181.5 | 63.3 | 18.5 | 39.9 | 21.1 |
| 6 | X440 | 1700 | 1200 | 148.6 | 164.2 | 65.2 | 18.0 | 36.3 | 50.0 |
| 7 | X440 | 1700 | 1250 | 125.6 | 139.5 | 68.0 | 20.0 | 30.6 | 161.6 |
| 8 | X440 | 1700 | 1300 | 108.0 | 122.4 | 72.4 | 23.0 | 24.5 | 200.2 |
| 9 | X441 | 1700 | 1150 | 165.3 | 183.2 | 60.7 | 17.5 | 40.0 | 31.1 |
| 10 | X441 | 1700 | 1200 | 152.2 | 166.0 | 65.2 | 18.0 | 36.4 | 74.0 |
| 11 | X441 | 1700 | 1250 | 130.8 | 141.5 | 68.9 | 20.0 | 31.3 | 207.4 |
| 12 | X441 | 1700 | 1300 | 112.8 | 124.4 | 69.7 | 21.5 | 25.4 | 195.2 |
| 13 | X442 | 1700 | 1150 | 166.1 | 183.4 | 61.5 | 17.0 | 40.3 | 21.1 |
| 14 | X442 | 1700 | 1200 | 152.6 | 165.7 | 64.1 | 18.0 | 36.5 | 44.4 |
| 15 | X442 | 1700 | 1250 | 131.3 | 142.0 | 66.6 | 19.5 | 30.9 | 126.0 |
| 16 | X442 | 1700 | 1300 | 113.9 | 124.8 | 69.6 | 21.0 | 25.6 | 177.9 |
| 17 | X227 | 1650 | 1200 | 108.1 | 123.3 | 68.9 | 21.5 | 24.2 | 149.7 |
| 18 | X228 | 1650 | 1200 | 126.8 | 138.7 | 64.6 | 19.0 | 29.6 | <120.0 |

Examples 3, 4, 7, 8, 11 and 12 are steels made in accordance with the composition and heat treatment parameters of this invention. The remaining examples listed in Table II differ from these parameters in one of more respects discussed below.

The criticality of the heat treatment procedure, especially the step of tempering at a temperature of at least 1200° F., is demonstrated by Example 1 from heat No. X439 which was tempered at a temperature of about 1150° F. Examples, 2, 3 and 4 from the same heat were tempered at temperatures about 1200° F., 1250° F. and 1300° F., respectively. It will be seen that the sigma 50 survival stress level, which factor is a measure of the hydrogen sulfide stress corrosion resistance, was only 21.1 ksi in the case of Example 1 as compared to 48.3 ksi, 163.8 ksi and 195 ksi for Examples 2, 3 and 4, respectively.

The unexpected, advantageous effect of the higher tempering temperature required by this invention is also demonstrated by a comparison of Example 5 to Examples 6, 7 and 8, Example 9 to Examples 10, 11 and 12, and Example 13 to Examples 14, 15 and 16. Example 5 tempered at 1150° F. had a survival stress level of 21.1 ksi, whereas Examples 6, 7 and 8 from the same heat, tempered at temperatures of 1200° F., 1250° F. and 1300° F., had survival stress levels of 50.0 ksi, 161.6 ksi and 200.2 ksi, respectively. Example 9 tempered at 1150° F. had a survival stress level of 31.1 ksi, whereas the same steel tempered at temperatures of 1200° F., 1250° F. and 1300° F. had survival stress levels of 74.0 ksi, 207.4 ksi and 195.2 ksi, respectively. Example 13 tempered at 1150° F. had a survival stress level of 21.1 ksi. The survival stress level of the steel at 1300° F. (Example 16) was 177.9 ksi. The values for Examples 14 and 15 were 44.4 ksi and 126.0 ksi, respectively.

The criticality of heat treating to a hardness less than 35 Rc and yield strengths up to a maximum of 145 ksi also is demonstrated by the examples reported in Table II. Examples 1 and 2 were tempered to higher hardnesses of 40.7 Rc and 37 Rc, respectively, and to higher yield strengths of about 164.9 ksi and 151.4 ksi, respectively. Examples 3 and 4 from the same heat were heat treated in accordance with the present invention and had survival stress levels of 163.8 ksi and 195.0 ksi, respectively.

Similar results were obtained with the specimens made from the other three heats of steel X440,X441 and X442. Examples 5, 6, 9, 10, 13 and 14 were all heat treated to hardnesses and yield strengths exceeding the ranges of the present invention, i.e., 35 $R_C$ and 145 ksi. Examples 7, 8, 11, 12, 15 and 16 were heat treated to hardnesses less than 35 Rc and yield strengths of from 90 to 145 ksi. The hydrogen sulfide corrosion resistance was substantially higher with the survival stress levels ranging from 126.0 ksi in the case of Example 15 to 207.4 ksi in the case of Example 11.

The effects of certain compositional variances also are made evident by the results presented in Table II. In particular, Examples 13, 14, 15 and 16 made from heat X442 demonstrate the adverse effects of a columbium content exceeding about 0.10%. In the case of heat X442, the columbium content was about 0.12% and the resulting sulfide stress corrision resistance at each reported strength level was significantly poorer than that of steels made in accordance with the invention. Example 15 from heat X442 had a survival stress value of 126.0 ksi at a strength level of 131.3 ksi, whereas Examples 3 and 11 which had lower columbium contents within the range of the invention had survival stress values of 163.8 ksi and 207.4 ksi at substantially the same strength level. Example 16 from heat X442 had a survival stress value of 177.9 ksi at a strength level of 113.9 ksi, whereas Examples 4, 8 and 12 had higher survival stress values of 195.0 ksi, 200.2 ksi and 195.2 ksi, respectively, at nearly the same strength level.

Examples 17 and 18 demonstrate the adverse effect of increased aluminum content above that required simply for deoxidization, i.e., up to about 0.10%. The steels for these examples had aluminum contents of 0.30 and 0.39, respectively. The survival stress value for Example 17 was 149.7 at a strength level of 108.1 ksi, whereas Example 8 had a survival stress value of 200.2 ksi at the same strength level. Example 18 had a survival stress value less than about 120.0 ksi at a strength level of 126.8 ksi, whereas Example 7 had a survival stress level of 161.8 ksi at about the same strength level.

Well casings were made from a heat of steel having the composition set forth in Table III. The casing steel was aluminum-killed, austenitized at a temperature of 1700° F., and tempered at a temperature of 1275° F. Various casing sizes, and the mechanical properties and survival stress level of each size are presented in Table IV.

TABLE III

| Heat | C | Mn | Si | P | S | Cu | Ni | Cr | Mo | V | Al |
|---|---|---|---|---|---|---|---|---|---|---|---|
| 67824 | .25 | .49 | .35 | .015 | .023 | .09 | .13 | 1.85 | .67 | .24 | .025 |

TABLE IV

| Example | Codes | Casing Size | Y.S. (ksi) | U.T.S. (ksi) | Elong. (% in 2") | Hardness (Rc) | Sigma 50 (ksi) |
|---|---|---|---|---|---|---|---|
| 19 | AA | 7" Dia. × .730" Wall | 138.0 | 148.5 | 19.0 | 33.4 | 166.2 |
| 20 | CC | 7" Dia. × .730" Wall | 128.0 | 142.0 | 20.0 | 32.3 | 160.0 |
| 21 | FF | 7" Dia. × 1.000" Wall | 142.0 | 154.0 | 19.0 | 34.4 | 117.0 |
| 22 | HH | 7" Dia. × 1.000" Wall | 147.0 | 161.0 | 19.0 | 35.3 | 77.1 |
| 23 | MM | 7" Dia. × 1.200" Wall | 123.0 | 165.0 | 19.0 | 35.1 | 79.4 |

Examples 19, 20 and 21 of Table IV have hardnesses and yield strengths well within the ranges contemplated by the present invention. It will be seen that the survival stress values range from 117 ksi for Example 21 to 166.2 ksi for Example 19. Example 22 has a higher yield strength of 147 ksi and a higher hardness of 35.3 $R_C$. The survival stress level of Example 22 was only 77.1 ksi as compared to 117 ksi for Example 21. Example 23 was heat treated to a hardness at the outer limit of the invention. The survival stress level of Example 23 was 79.4 as compared to 117 ksi for Example 21.

Well casings were made from another heat of aluminum-killed steel having the composition set forth in Table V. The casing was austenitized at a temperature of 1700° F. and tempered at temperatures ranging from 1200° to 1350° F. The mechanical properties and survival stress levels are presented in Table VI.

TABLE V

| C | Mn | Si | P | S | Cr | Mo | V | Al |
|---|---|---|---|---|---|---|---|---|
| 0.25 | 0.50 | 0.29 | .008 | 0.022 | 1.90 | 0.63 | 0.22 | 0.024 |

TABLE VI

| Ex. | Tempering Temp (F.) | Y.S. (ksi) | U.T.S. (ksi) | R.A. (%) | Elong. (% in 1") | Hardness ($R_C$) | Sigma 50 (ksi) |
|---|---|---|---|---|---|---|---|
| 24 | 1200 | 165.4 | 180.6 | 61.0 | 16.5 | 39.1 | 69.1 |
| 25 | 1250 | 145.8 | 157.7 | 64.3 | 17.5 | 34.8 | 106.3 |
| 26 | 1275 | 130.1 | 141.8 | 66.9 | 20.0 | 30.3 | 187.2 |
| 27 | 1300 | 117.8 | 130.1 | 70.5 | 20.5 | 27.2 | 199.5 |
| 28 | 1350 | 100.6 | 115.7 | 73.2 | 23.0 | 22.4 | 187.5 |

Example 24 was heat treated to a hardness and yield strength outside the ranges of the present invention. The survival stress level was 69.1 ksi. Example 25 was heat treated to a hardness and yield strength at the outer limits of the invention (about 35 Rc and 145 ksi). The survival stress level of 106.3 ksi was appreciably higher than that of Example 24. Examples 26, 27 and 28 were heat treated within the preferred ranges of the invention. The survival stress levels ranged from about 187 ksi for Examples 26 and 28, to 199.5 ksi for Example 27.

It has been demonstrated by all of the foregoing examples that precise control of composition and heat treatment within the ranges specified by the invention are needed to obtain the best hydrogen sulfide corrosion stress resistance. Seemingly slight variations in chemistry, such as increasing the columbium or aluminum contents as in the case of Examples 15–18, while maintaining all other parameters of the invention, result in markedly poorer sulfide stress corrosion resistance at any given strength level. Conversely, slight variations in heat treatment procedure while maintaining the chemistry within the ranges of the invention decreases sulfide stress corrosion resistance. It will therefore be seen that the specific interelation of chemistry and heat treatment as taught by the invention produces improved, synergistic results.

Many modifications and variations of the invention will be apparent to those skilled in the art in light of the detailed disclosure. Therefore, it is to be understood that, within the scope of the appended claims, the invention can be practiced otherwise than as specifically described.

We claim:

1. A process of making well casing characterized by improved hydrogen sulfide stress cracking resistance at high yield strengths ranging from about 90 to 145 ksi comprising the steps of providing an aluminum-killed steel consisting essentially in amounts by weight of from 0.10 to 0.40% carbon, 0.25 to 0.75% manganese, 0.05 to 0.50% silicon, 1.0 to 5.0% chromium, 0.30 to 1.0% molybdenum, 0.05 to 0.55% vanadium, 0.02 to 0.10% aluminum, and the balance iron except normal steel making impurities; rolling and forming the steel into tubular form; austenitizing the casing at a temperature of from 1550° to 1700° F., quenching the casing to obtain a microstructure which is essentially martensite, and tempering the casing at a temperature of from 1200° to 1400° F. to a maximum hardness of 35 $R_C$ and a microstructure which is essentially tempered martensite.

2. A process of making well casing characterized by improved hydrogen sulfide stress cracking resistance at high yield strengths ranging from about 90 to 145 ksi comprising the steps of providing an aluminum-killed steel consisting essentially in amounts by weight of from 0.15 to 0.35% carbon, 0.35 to 0.65% manganese, 0.10 to 0.35% silicon, 1.5 to 3.0% chromium, 0.40 to 0.80% molybdenum, 0.10 to 0.30% vanadium, about 0.02 to 0.08% aluminum, and the balance iron except normal steel making impurities; rolling and forming the steel into tubular form; austenitizing the casing at a temperature of from 1550° to 1700° F.; quenching the casing to obtain a microstructure which is essentially martensite, and tempering the casing at a temperature of from 1200° to 1400° F. to a maximum hardness of 35 $R_C$ and a microstructure which is essentially tempered martensite.

3. A process according to claim 1 or claim 2 wherein the steel includes 0.01 to 0.05% by weight columbium.

4. A process according to claim 1 or claim 2 wherein the steel includes one or more of the following elements in amounts by weight: 0 to 1.0% nickel, 0 to 0.25% titanium, 0 to 1.0% copper, 0 to 3.0% cobalt, 0 to 0.25% tungsten, 0 to 0.50% tantalum, and 0 to 0.10% columbium.

5. Quenched and tempered well casing characterized by improved hydrogen sulfide stress cracking resistance at high yield strengths ranging from about 90 to 145 ksi comprising an aluminum-killed steel consisting essentially in amounts by weight of from 0.10 to 0.40% carbon, 0.25 to 0.75% manganese, 0.05 to 0.50% silicon, 1.0 to 5.0% chromium, 0.30 to 1.0% molybdenum, 0.05 to 0.55% vanadium, 0.02 to 0.10% aluminum, and the balance iron except normal steel making impurities, the steel having a maximum hardness of 35 $R_C$ and a microstructure which is essentially tempered martensite.

6. Quenched and tempered well casing characterized by improved hydrogen sulfide stress cracking resistance at high yield strengths ranging from about 90 to 145 ksi comprised of an aluminum-killed steel consisting essentially in amounts by weight of from 0.15 to 0.35% carbon, 0.35 to 0.65% manganese, 0.10 to 0.35% silicon, 1.5 to 3.0% chromium, 0.40 to 0.80% molybdenum, 0.10 to 0.30% vanadium, about 0.02 to 0.08% aluminum, and the balance iron except normal steel making impurities, the steel having a maximum hardness of 35 $R_C$ and a microstructure which is essentially tempered martensite.

7. Well casing according to claim 5 or claim 6 wherein the steel includes 0.01 to 0.05% by weight columbium.

8. Well casing according to claim 5 or claim 6 wherein the steel includes one or more of the following elements in amounts by weight: 0 to 1.0% copper, 0 to 3.0% cobalt, 0 to 0.25% tungsten, 0 to 0.50% tantalum, and 0 to 0.10% columbium.

* * * * *